United States Patent [19]

Durham, Jr.

[11] Patent Number: 4,949,506

[45] Date of Patent: Aug. 21, 1990

[54] WINDOW CONSTRUCTION

[75] Inventor: Robert C. Durham, Jr., Ft. Lauderdale, Fla.

[73] Assignee: Chelsea Industries, Inc., Boston, Mass.

[21] Appl. No.: 440,866

[22] Filed: Nov. 24, 1989

[51] Int. Cl.[5] ..... E06B 3/00

[52] U.S. Cl. ..... 49/449; 49/DIG. 2; 49/445; 49/501; 49/504; 52/207; 52/475; 52/656; 52/731; 52/774; 52/775

[58] Field of Search ..... 49/449, 445, 446, 504, 49/501, DIG. 2; 52/207, 788, 475, 477, 731, 656, 773, 774, 775, 776

[56] References Cited

U.S. PATENT DOCUMENTS

| | | | |
|---|---|---|---|
| 2,795,306 | 6/1957 | Fey et al. | 52/773 |
| 3,859,754 | 1/1975 | Budich et al. | 40/425 |
| 4,328,644 | 5/1982 | Scott et al. | 49/504 X |
| 4,555,800 | 6/1984 | Hosooka et al. | 52/309 |
| 4,640,078 | 2/1987 | Haffer | 52/788 |
| 4,676,026 | 6/1987 | Schreiner | 49/501 |
| 4,740,405 | 4/1988 | Tanaka et al. | 428/45 |
| 4,742,647 | 5/1988 | Pacca | 49/50.5 |
| 4,815,246 | 3/1989 | Haas | 52/207 |
| 4,831,781 | 5/1989 | Morton | 49/504 |

*Primary Examiner*—Philip C. Kannan

*Attorney, Agent, or Firm*—Oltman and Flynn

[57] ABSTRACT

This is a window assembly with one sliding window, one fixed window and a rectangular framework made up of extruded framework members with the same cross-sectional profile except for small segments that are removed in the framework members along which the sliding windows slide. Three of these framework members support the fixed window pane along three edges. The sliding window has extruded peripheral members along its edges which have the same cross-sectional profile as one another except where small segments are removed in two of them to slidably interfit with the two framework members along which the sliding window slides. An additional peripheral member of this cross-section is part of the framework and supports the fixed window along its remaining edge. Springs inside the two framework members along which the sliding windows slide urge the sliding window to an open position.

29 Claims, 4 Drawing Sheets

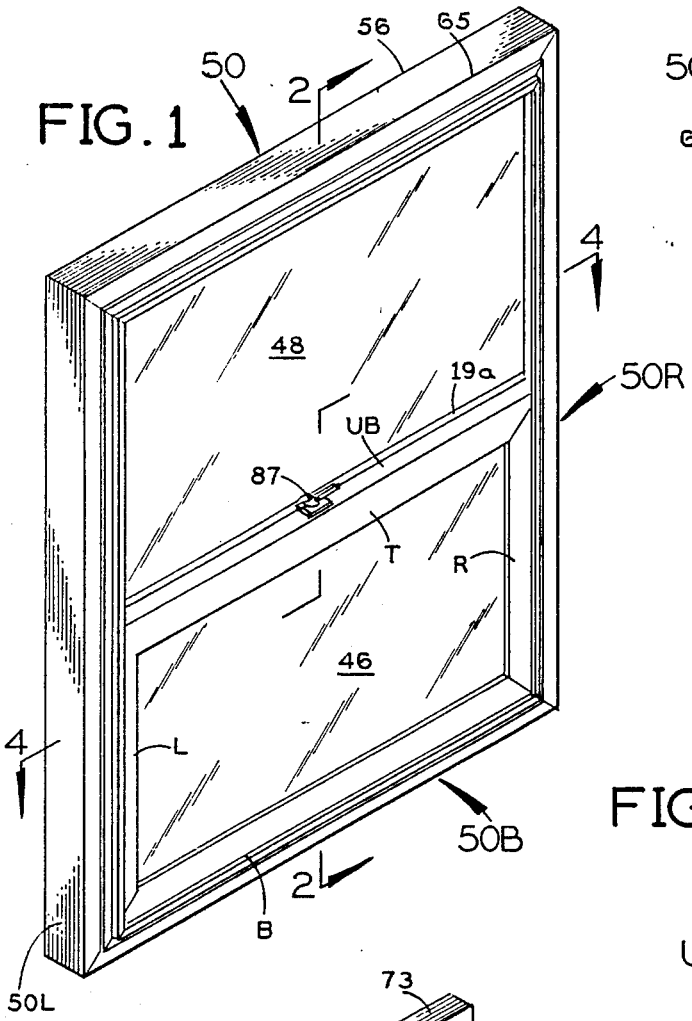
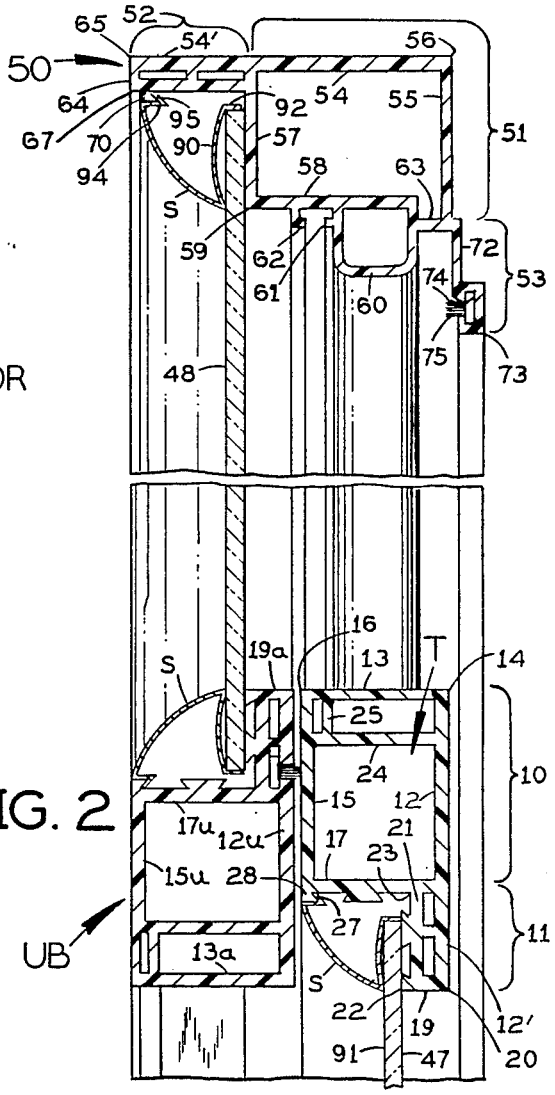
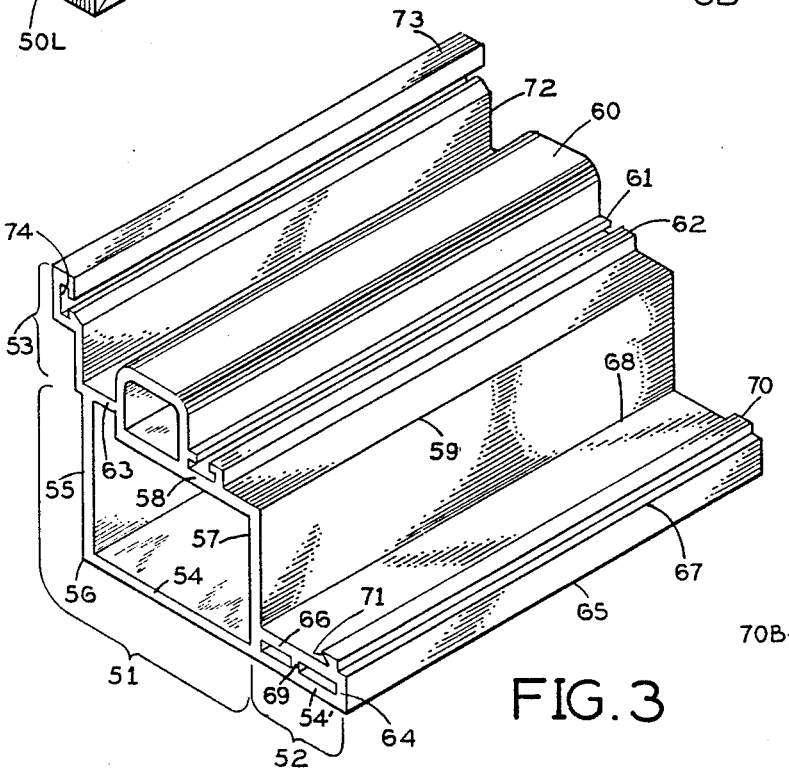
FIG. 3

WINDOW CONSTRUCTION

SUMMARY OF THE INVENTION

This invention relates to (1) a window assembly having a fixed window and a slidable window and a framework holding the windows which is attachable to a building wall at a window opening therein and (2) an extruded framework member of novel cross-sectional profile for such a window assembly.

One objective of this invention is to simplify and reduce the cost of making the installations of a single-hung window (with a fixed upper window and a vertically slidable lower window) or a horizontally slidable window (with a fixed window on one side and a slidable window on the other side). This objective is achieved by providing:

(1) an extruded peripheral member, for holding the pane of the sliding window along all four edges and for holding the pane of the fixed window along one edge, which has the same extruded cross-section in all such positions except for one small segment which is either present or removed, depending upon which edge the peripheral member will be positioned at; and (2) an extruded framework member, for slidably holding the slidable window (including its peripheral members) and for holding the pane of the fixed window along its remaining three edges, which has the same extruded cross-section in all positions except for small segments which are either present or removed, depending upon where the framework member will be positioned in the window assembly.

The peripheral members for the window panes are cut to size from a long extruded plastic body and, where necessary, a small segment is cut away or otherwise removed. Similarly, the framework members are cut to size from a long extruded plastic body and, where necessary, small segments are cut away or otherwise removed. Thus, only two types of extrusions, one for the window peripheral members and another for the framework members, need be kept in stock and from them can be made a single-hung window or a horizontally slidable window of any size desired.

Preferably, the framework extrusion is designed to receive springs for biasing the sliding window (either in a single-hung window installation or in a horizontally slidable window installation) to its open position so that very little effort is required for a person to open the window.

One principal object of this invention is to provide a novel window assembly having a sliding window and a stationary window, peripheral members on the windows which have in common substantially the same cross-sectional profile, and a framework for the two windows made up of four framework members having in common essentially the same cross-sectional profile.

Another principal object of this invention is to provide a novel framework member for a window assembly having a sliding window and a stationary window, which framework member has a novel cross-sectional profile that enables an entire rectangular framework for the two windows to be made up of such framework members, with only a small part of that profile removed from the framework members along which the sliding window slides.

Another object of this invention is to provide a novel window assembly including stationary window and a sliding window, a rectangular framework composed of four framework members with essentially the same cross-sectional profile, three of which directly support the pane of the stationary window, peripheral members supporting the pane of the sliding window and having essentially the same cross-sectional profile as each other, and an additional peripheral member of that same cross-sectional profile forming part of the framework and supporting the remaining edge of the pane of the stationary window.

Another object of this invention is to provide a novel window assembly which is resistant to wind forces and to any twisting of the frame and window sash members, has good weather and moisture resistance, and minimizes inventory and resultant cost and storage factors because many different parts of the assembly have essentially the same cross-sectional profile, enabling the use of fewer extrusion dies and production dies and simplifying the production of the window assembly.

Further objects and advantages of this invention will be apparent from the following detailed description of two presently-preferred embodiments, one a single-hung window assembly and the other a horizontally slidable window assembly.

DESCRIPTION OF THE DRAWINGS

FIG. 1 is a perspective view of a single-hung window assembly embodying the present invention, showing the side of the window assembly that faces the inside of the building;

FIG. 2 is a vertical cross-section taken along the line 2—2 in FIG. 1;

FIG. 3 is a perspective view of a short length of one of the framework members in the window assembly according to the present invention;

Figure 4:
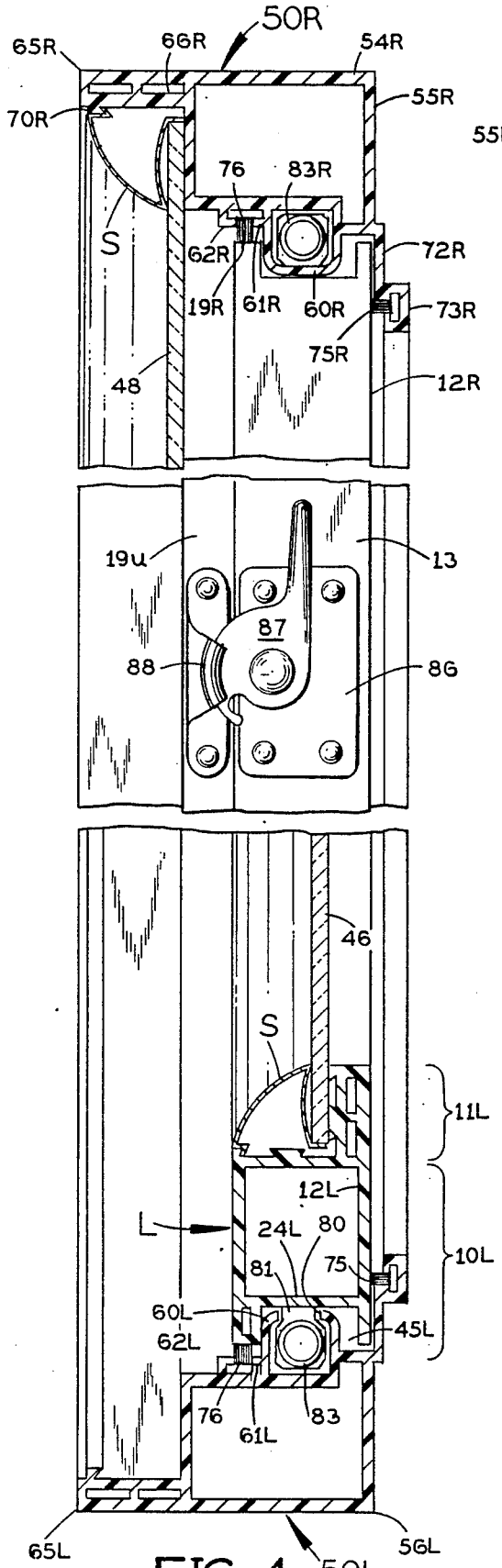
FIG. 4 is a horizontal cross-section taken along the line 4—4 in FIG. 2.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

Single-hung Window-FIGS. 1-5

Referring first to FIG. 2, which shows a single-hung window assembly, the vertically sidable lower window has a top peripheral member T which has a main body 10 of generally rectangular cross-section and an extension 11 of narrower cross-section joined integrally to the lower end of the main body at the side of the window on the outside of the building. Preferably, the peripheral member T is a one-piece extrusion of polyvinyl chloride or other suitable plastic as shown in enlarged detail in FIG. 10.

The main body 10 of the top peripheral member T has a first side 12 presenting an exposed flat outside face which faces toward the inside of the building, an outer end 13 at the top presenting an exposed flat outer end face intersecting the exposed face of the first side 12 at a right-angled first outside corner 14, a second side 15 presenting an exposed flat outside face which faces toward the outside of the building and intersects the outer end face 13 at a right-angled second outside corner 16 on the main body 10 and extends parallel to the exposed face of the first side 12, and an inner end 17 extending parallel to and below the outer end 13 between the first and second sides 12 and 15 and forming a right-angled third outside corner 18 with the exposed face of the second side 15.

The extension 11 on the top peripheral member T is joined integrally to its main body 10 at its inner end 17. The extension projects from the main body in the direction away from its outer end 13, i.e., downward. Extension 11 has a first side 12' which presents an exposed flat face on the outside that is a coplanar continuation of the exposed face of the first side 12 of the main body 10. Extension 11 at the bottom has an outer end 19 which presents an exposed end face that perpendicularly intersects the exposed face of its first side 12' at a right-angled fourth outside corner 20 on the top peripheral member T. Extension 11 has a second side 21 extending generally parallel to its first side 12' between its outer end 19 and the inner end 17 of the main body 10 of the peripheral member. The second side 21 of the extension forms a right-angled fifth outside corner 22 with its outer end 19 and forms a right-angled inside corner 23 with the inner end 17 of the main body.

The main body 10 of the peripheral member is hollow between its first and second sides 12 and 15 and its ends 13 and 17 except for a first reinforcing wall 24, which extends between its sides 12 and 15 parallel to its end 13, and a second reinforcing wall 25, which extends between the first reinforcing wall 24 and the end 13 parallel to the second side 15.

The main body 10 has a longitudinal first groove 26 in its inner end 17 near the third outside corner 18. This groove has a flat bottom surface 27 and opposite side edges 28 and 29 which incline toward each other away from the bottom surface 27, so that the groove has its narrowest width at the exposed flat faces 30 and 31 of inner end 17, which are located on opposite sides of groove 26. Between the inside corner 23 and its exposed face 31, the inner end presents a longitudinal recess 32 of the same depth as groove 26.

The extension 11 on the peripheral member is formed with rectangular cavities 33 and 34 between its first and second sides 12' and 21. These cavities are separated by a reinforcing segment 35 which extends perpendicularly between sides 12' and 21. The extension has a longitudinal second groove 36 in its second side 21 near the fifth outside corner 22 on the peripheral member. This groove has a flat bottom surface 37 and opposite side edges 38 and 39 which incline toward each other away from the bottom surface 37 so that the groove has its narrowest width at the exposed flat faces 40 and 41 of the second side 21 of the extension. Between the inside corner 23 and its exposed face 41 the second side 21 of the extension presents a longitudinal recess 42 of the same depth as its groove 36. The recess 32 in the inner end 17 of the main body 10 and the recess 42 in the second side 21 of the extension 11 intersect at the inside corner 23 of the top peripheral member T.

The lower window has a bottom peripheral memeber B which has the same cross-section as the top peripheral member T except that most of the outer wall 13 in peripheral member T is absent from the bottom peripheral member B. The bottom peripheral member B is inverted with respect to the top member T and corresponding elements of member B have the same reference numbers as the elements of member T but with a "b" suffix added. Thus, in bottom peripheral member B the extension **11*b* projects up from the main body 10*b* whereas in the top peripheral member T the extension 11 projects down from the main body 10. The lower peripheral member B presents a downwardly-facing recess 45*b* of rectangular cross-section where its outer wall is removed (between its first said 12*b* and its second reinforcing wall 25*b* and below its first reinforcing wall 24*b***).

Figure 10:
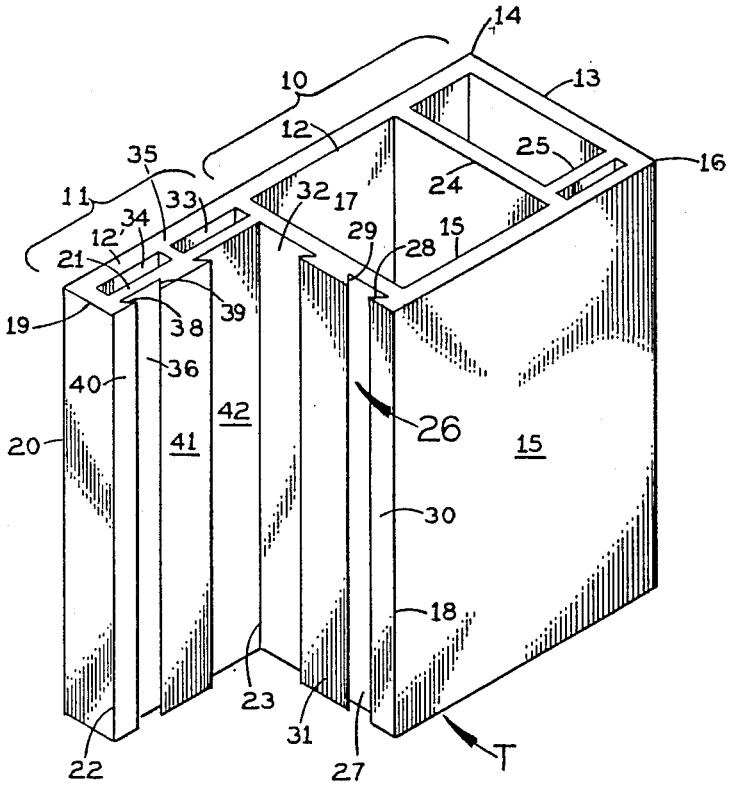
FIG. 10 is a perspective view of one of the peripheral members for windows in either the single-hung window assembly of FIGS. 1–5 or the horizontally slidable window assembly of FIGS. 6–9.
Figure 7:
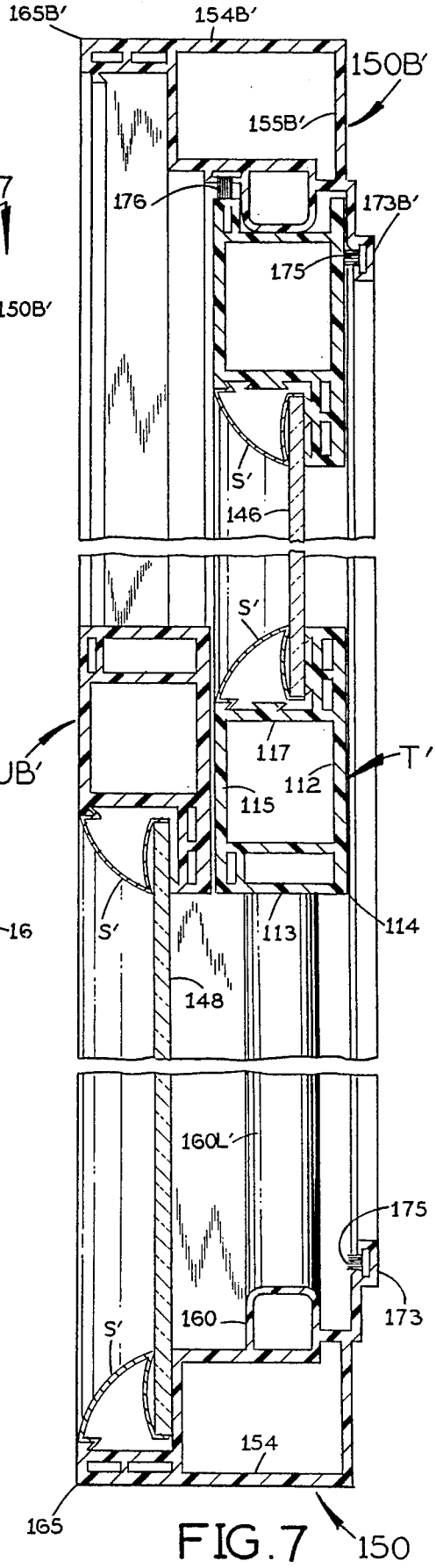
FIG. 7 is a horizontal cross-section taken along the line 7—7 in FIG. 6.
Figure 8:
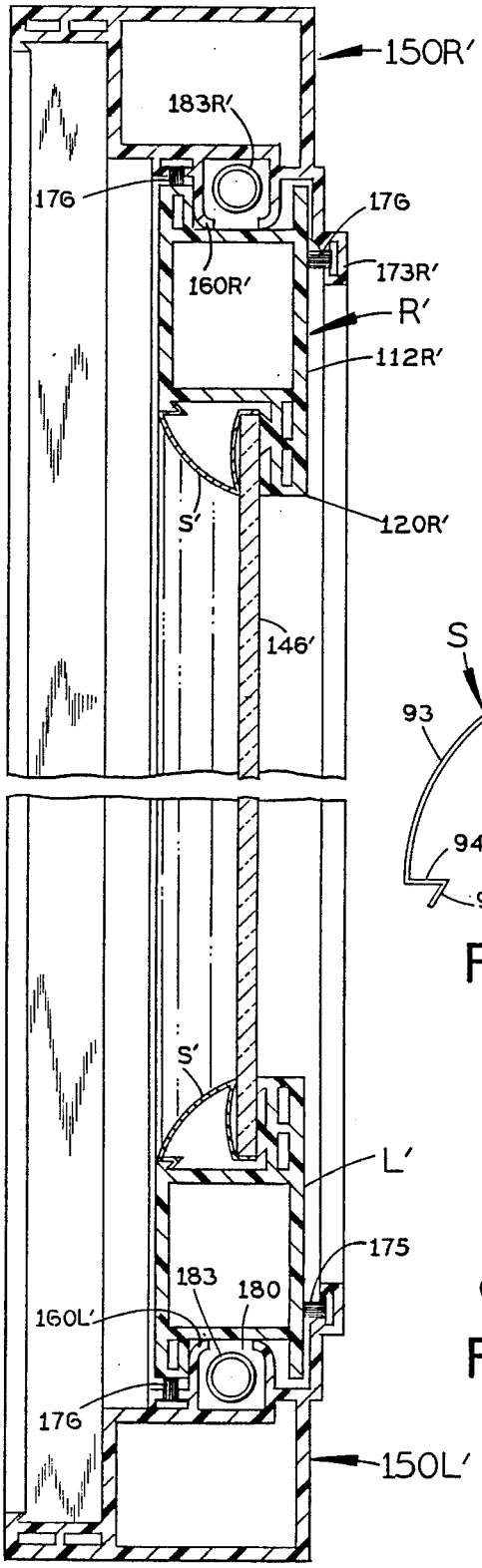
FIG. 8 is a vertical cross-section taken along the line 8—8 in FIG. 6 through the sliding window.

The lower window has side peripheral members L and R along its opposite side edges in FIG. 1 which have the same cross-section as its bottom peripheral member B, as shown in FIG. 4 for the left side peripheral member L. In FIG. 10 the left side peripheral member has the same reference numerals for its elements as the bottom peripheral member B in FIG. 2 but with an "L" suffix instead of a "b" suffix. The recess 45L in the leftside peripheral member L is open along the laterally outward side of this peripheral member, and the extension 11L projects laterally inward from the main body 10L of this peripheral member.

The right side peripheral member R of the lower window is a mirror image of the left side peripheral member L.

Thus, the four peripheral members T, B, L and R of the sliding lower have in common an identical extruded cross-section and all but the top peripheral member T have the outer end 13 of this extruded cross-section removed between its first side 12 and its second reinforcing wall 25, leaving a recess or cavity which is open on that side of the peripheral member along its entire length.

The top, bottom, left and right side peripheral members T, B, L and R of the bottom window are joined to each other at mitered corners to form a rectangular frame holding the lower window pane 46.

Figure 11:
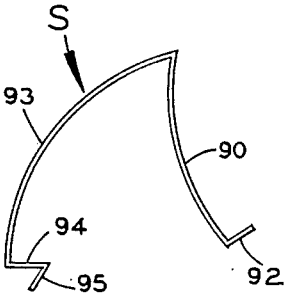
FIG. 11 is an end elevation of one of the glazing strips in either of these window assemblies.

Along each edge the window pane 46 is held in the adjacent peripheral member T, L, R and B by an extruded, flexible and resilent, plastic glazing strip S (FIG. 11) having a slightly bowed front leg 90 engaging the outside face 91 of the window pane 46, a narrow transverse lip 92 at one end of leg 90 extending across the edge of the window pane, an arcuate leg 93 extending away from the opposite end of leg 90, a narrow flange 94 joined to the opposite end of the arcuate leg 93 from its attachment to leg 90 and extendng from arcuate leg 93 toward leg 90, and a transverse lip 95 joined to the edge of flange 94 away from its connection to the curved leg 93. The lip 95 on the glazing strip projects into the first groove 26 in the adjacent peripheral member T, L, R or B on the lower window and engages the side face 28 of this groove, while the flange 94 on the glazing strip engages the exposed face 30 of the adjacent peripheral member between its third outside corner 18 and groove 26.

Each glazing strip S is stressed and resiliently deformed by its engagement with the window pane 46 and the adjacent peripheral member T,B,L or R, as shown. The stressed glazing strip resiliently holds the inside face 47 of the window pane 46 against the exposed faces 40 and 41 of the extension 11 on the adjacent peripheral member of the window.

The fixed upper window has a bottom peripheral member UB with the same cross-section (FIG. 10) as the top peripheral member T of the vertically slidable lower window. Peripheral member UB is inverted and reversed back-to-front from peripheral member T. Elements of peripheral member UB which correspond to those of peripheral member T have the same reference numerals with a "u" suffix added. As shown in FIGS. 1 and 2, the bottom peripheral member UB extends along the bottom edge of an upper window pane 48. A glazing strip S is engaged between peripheral member UB and this window pane in the manner already described for the lower window pane.

The window assembly also has a rectangular framework that is attached to the building wall at an opening therein for this window assembly. This rectangular framework slidably supports and holds the lower window consisting of the peripheral members T, B, L and R, lower window pane 46, and the glazing strips S holding this pane against these peripheral members. This rectangular frame-work also directly engages and supports the pane 48 of the fixed upper window along its top edge and along its opposite side edges.

As shown in FIG. 1, this rectangular framework has a horizontally elongated top member 50, a horizontally elongated bottom member 50B, and vertically elongated left and right side members 50L and 50R extending between the top and bottom members. The top, bottom and side members 50, 50B, 50L and 50R of the framework are joined to each other at mitered corners. Each member of the framework has a cross-section as shown in FIG. 3.

Referring to FIGS. 2 and 3, in board outline the framework member 50 has a hollow, generally rectangular main body 51, a first extension 52 on one end of the main body at the outside of the framework member, and a second extension 53 diagonally opposite the first extension.

The main body 51 of top framework member 50 has a flat, outer, first side 54 presenting an exposed flat face on the outside which in FIG. 2 is the top face of the framework. This face will extend next to the top edge of the window opening in the building wall. Toward the inside of the building, the main body of framework member 50 presents a flat, outer, first end 55 with an exposed flat outer end face which intersects the first side 54 at a right-angled first outside corner 56. Toward the outside of the building, the main body 51 of framework member 50 presents a flat, inner, second end 57 which intersects the outer first side 54 perpendicularly and extends parallel to the first end 55. A flat, inner, second side 58 perpendicularly intersects the second end 57 away from the outer first side 54 at a second outside corner 59 and extends parallel to the first side 54. A hollow projection 60 of generally U-shaped cross-section is joined to the second side 58 and extends from it away from the first side 54, i.e., downward. On its side facing the outside of the building, projection 60 has a narrow lip 61 of rectangular cross-section which is spaced a short distance below the second side 58. A projection 62 of L-shaped cross-section extends from the second side 58 a short distance away from lip 61 toward the outside of the building. Projection 62, lip 61 and the outer (bottom) face of side 58 define a slot of T-shaped cross-section. On the opposite side of the generally U-shaped projection 60, a short inner wall 63 connects this projection to the first end 55 of its main body and projects slightly past end 55 toward the inside of the building. Wall 63 extends parallel to the second side 58 and is offset from it in a direction away from the first side 54.

The first extension 52 on framework member 50 has a first side 54' presenting an exposed flat face on the outside that is a coplanar continuation of the exposed outside face of the first side 54 of the main body 51 of member 50. Extension 52 has an outer end 64 which presents an exposed end face that perpendicularly intersects the exposed face of its first side 54' at a right-angled third outside corner 65 on framework member 50. Extension 52 has a second side 66 (FIG. 3) extending parallel to its first side 54' between its outer end 64 and the second end 57 of the main body 51 of this framework member. The second side 66 of extension 52 forms a right-angled third outside corner 67 with its outer end 64 and forms a right-angled inside corner 68 with the inner end 57 of the main body 51 of this framework member. A reinforcing wall 69 extends between the first and second sides 54' and 66 of the first extension 52. A short distance in from the outer end 64 this extension, its second side 66 carries a projection 70 which presents an inclined face 71 on the side facing the inside corner 68. This inclined face extends at an acute angle to the seond side 66 in a direction toward the inner end 57 of the main body so that they form a V-shaped groove that is open toward the inside corner.

The second extension 53 on framework member 50 has a flat segment 72 extending perpendicularly from the inner wall 63 of the main body 51 and offset from the outer first end 55 of the main body toward the inside of the building. A channel segment 73 is joined to segment 72 away from its attachment to wall 63 a short distance beyond the innermost extent of projection 60 on the main body 51 of framework member 50. Channel segment 73 projects from segment 72 toward the inside of the building and it defines a slot or recess 74 of T-shaped cross-section which is open toward the outside of the building.

Elements of each of the other three framework members 50L, 50R and 50B which correspond to those of the top framework member 50 have the same reference numerals and an "L", "R" or "B" suffix, as the case may be.

As shown in FIG. 4, the projection 60L on the framework member 50L at the left side fits in the recess 45L which extends along the outside of the peripheral member L on the left side of the lower window. Projection 60L engages walls 24L and 25L of member L and it provides an interlock between framework member 50L and peripheral member L of the lower window. The projection 60R on framework member 50R at the right side coacts in the same manner with the adjacent peripheral member R on the lower window. Projections 60L and 60R locate the lower window and guide it when it is raised or lowered, and in all positions of the lower window they reinforce it against forces from the inside or the outside, such as wind forces, and prevent it from twisting.

When the lower window is down (FIG. 2), the projection 60B on lower framework member 50B fits in the recess **45*b*** along the bottom of the bottom peripheral member B of the lower window and reinforces it in the same manner.

A glazing strip S as already described acts between each framework member 50, 50L and 50R and the upper window pane 48 to hold this window pane in place, as shown in FIg. 2. As shown at the top framework member 50, the lip 92 of the glazing strip engages the adjacent edge of the upper window pane 48 and the flange 94 and lip 95 at the opposite end of the glazing strip engage the projection 70 on the first extension 52 of the framework member.

Figure 12:
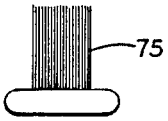
FIG. 12 is an end elevation of one of the weather-strip members in each embodiment of the present window assembly.
Figure 9:
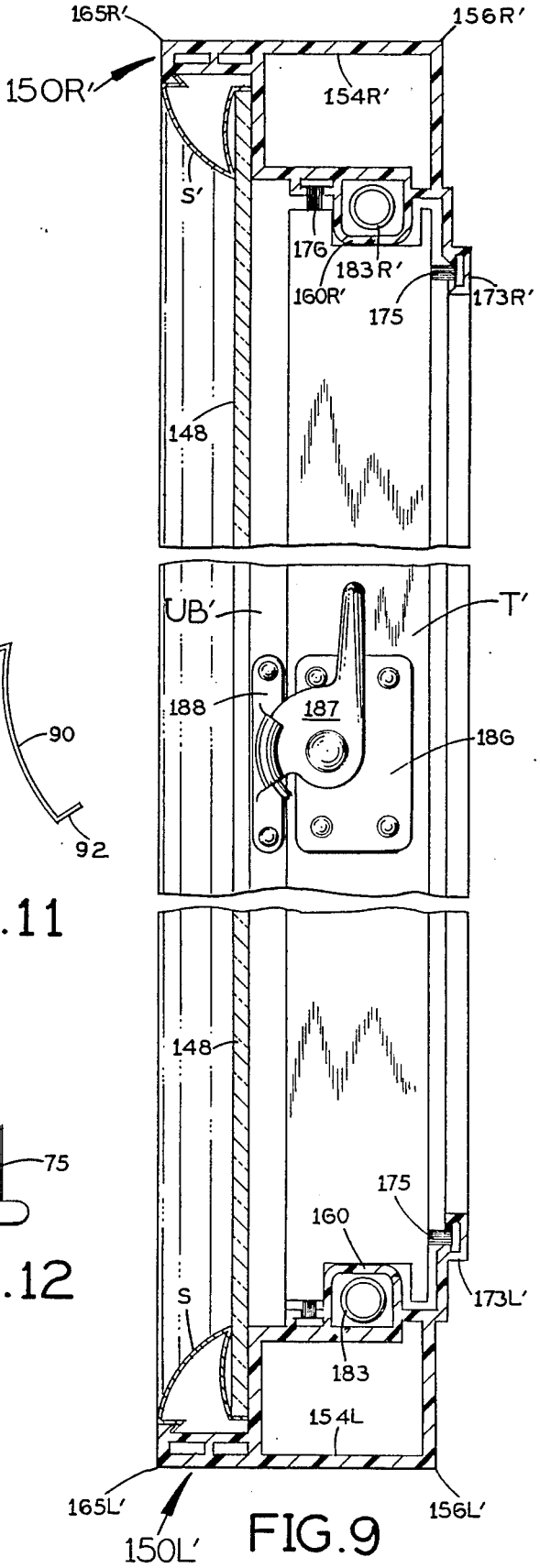
FIG. 9 is a vertical cross-section taken along the line 9—9 in FIG. 6 through the fixed window.

A weatherstrip member 75 (FIG. 12) is seated in the T-shaped slot 74 in the second extension 73 of each of the framework members 50, 50L, 50R and 50B. As shown in FIG. 2, the weatherstrip member 75 carried by the second extension of the framework member 50B at the bottom of the window assembly engages the first side **12*b* of the bottom peripheral member B on the lower window when that is down. The weatherstrip member 75 carried by the framework member 50 at the top of the window assembly is positioned to engage the first side 12 of the top peripheral member T on the lower window when that window is fully raised. As shown in FIG. 4, the weatherstrip member 75 on the framework member 50L at the left side of the window assembly engages the first side 12L of the peripheral member L along the left side of the lower window and the weatherstrip member on the framework member 50R at the right side of the window assembly engages the first side 12R** of the peripheral member R along the right side of the lower window.

As shown in FIG. 4, a similar weatherstrip member 76 is seated in the T-shaped slot between lip 61L and projection 62L on the framework member 50L. This weatherstrip member engages the peripheral member L on the left edge of the lower window along the outer end 19L of the extension of that peripheral member. Similarly, the framework member 50R on the right side of the window assembly carries an identical weatherstrip member 76 in the T-shaped slot between its lip 61R and projection 62R. This weatherstrip member engages the outer end 19R of the extension on this peripheral member. As shown in FIG. 2, the bottom framework member 50B carries a similarly positioned weatherstrip member 76 which is engaged by the end **13*b*** of the bottom peripheral member B on the lower window when that window is all the way down.

Figure 5:
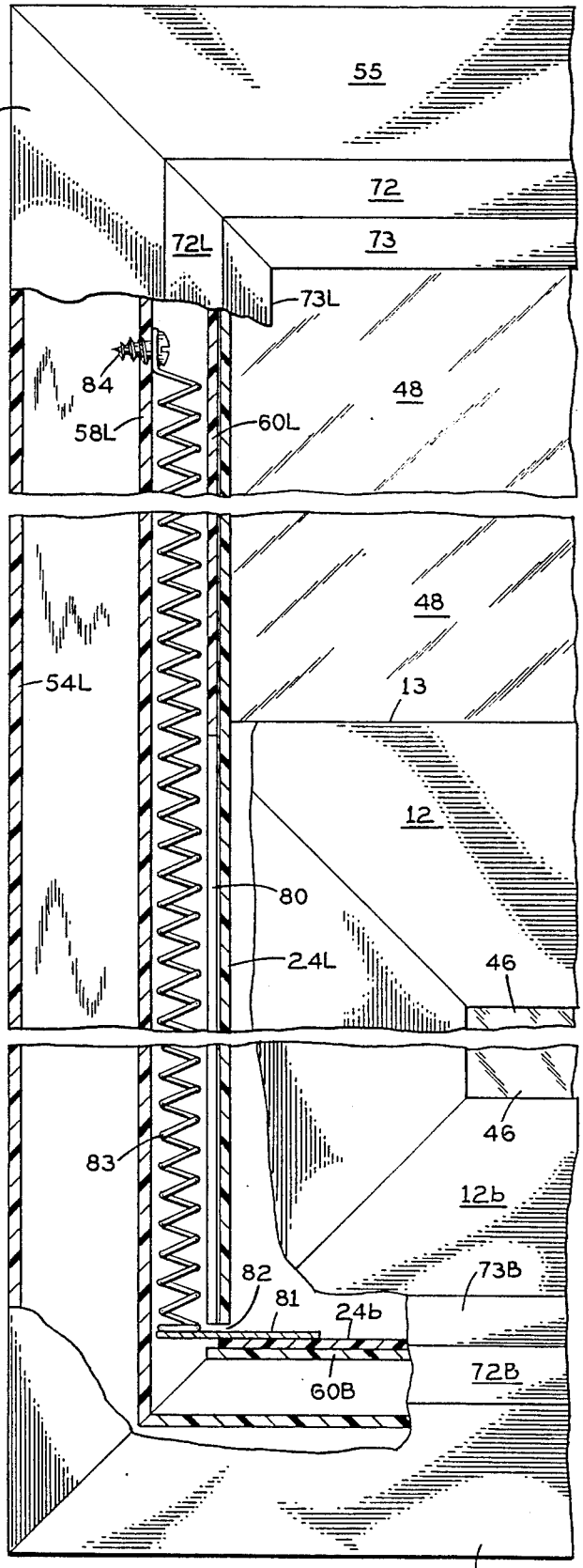
FIG. 5 shows this window assembly partly in front elevation and partly in vertical section and with parts broken away.

As shown in FIG. 5, the inner wall of the generally U-shaped projection 60L on the framework member 50L at the left side of the window assembly has a longitudinal slot 80 which is open at the lower end of this framework member and extends up almost to the top 13 of the top peripheral member T on the lower window when that window is all the way down. An attachment member in the form of a plate 81 is rigidly affixed to wall **24*b* of the bottom peripheral member B on the lower window. Plate 81 projects through an opening 82 in the lower end of wall 24L in the peripheral member L on the left side of the lower window and slidably through slot 80 into the hollow interior of the generally U-shaped projection 60L on the left framework member 50L. The lower end of a coil spring 83 is affixed to plate 81. This spring extends up along the interior of projection 60L on the left framework member 50L to a screw 84 which anchors its upper end to the second side 58L of this framework member near its upper end. Spring 83** is under tension and it pulls up on the lower window, so that a person needs very little effort to raise the lower window.

An identical arrangement is provided at the right side of the window assembly. The spring on this side appears as 83R in FIG. 4.

The window assembly has a lock of conventional design for locking the top peripheral member T on the lower window to the bottom peripheral member UB on the fixed upper window. As shown in FIG. 4, this lock comprises a plate 86 fastened on top of end wall 13 of peripheral member T on the lower window and pivotally supporting a locking member 87 which is engageable with a complementary locking member 88 attached to and extending up from the outer end **19*u*** of the extension on the lower peripheral member UB at the bottom of the fixed upper window.

Horizontally Slidable Window-FIGS. 6–9

FIGS. 6–9 show a second embodiment of the invention which differs from the first in that it has a horizontally slidable window instead of a vertically slidable window. Except for a change in the horizontal and vertical proportions the embodiment of FIGS. 6–9 is like the embodiment of FIGS. 1–5 turned on one side, with the left framework member 50L now at the bottom and the sliding window now on the right side. Elements of the window assembly in FIGS. 6–9 have the same reference numerals plus 100 as those in FIGS. 1–5 and the same letter suffixes with a "prime" added. With this in mind, a detailed description of these elements is believed unnecessary to an understanding of the second embodiment.

Figure 6:
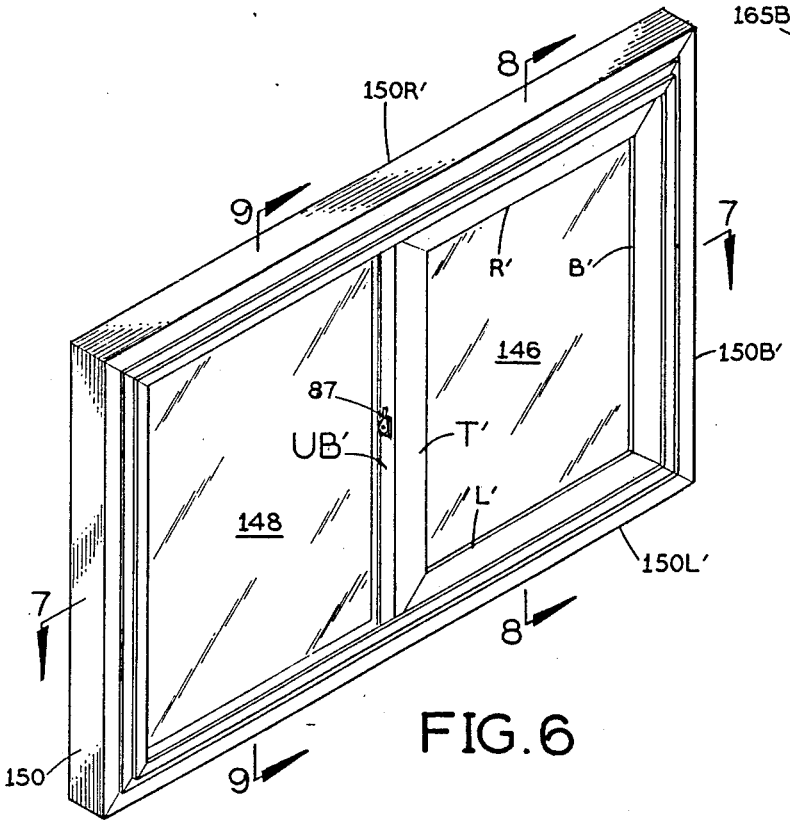
FIG. 6 is a perspective view of a window assembly according to this invention having a horizontally slidable window, showing the side of this window assembly that faces the inside of the building.

As shown in FIG. 6, the framework member 150 on the left side of the window assembly corresponds to the framework member 50 at the top in FIG. 1, the framework member 150R' at the top corresponds to the framework member 50R at the right side in FIG. 1, the framework member 150B' at the right side corresponds to the bottom framework member 50B in FIG. 1, and the framework member 150L' on the bottom corresponds to the framework member 50L on the left side in FIG. 1. With the window closed, as shown in FIG. 6, the peripheral member T' of the right-hand window extends vertically in front of the peripheral member UB' on the right side of the left-hand window pane 148 and can be locked to it by a lock 186, 187, 188, (FIG. 9) in the same manner as the lock 86, 87 and 88 in FIG. 4 of the first embodiment. Tension springs 183 and 183R' at the top and bottom urge the right-hand window toward the left when the lock is released so that very little effort by a person is required to slide the right-hand window to an open position.

Obviously, the window assembly of FIGS. 6–9 could be reversed from left to right to make the left-hand window the sliding window and the right-hand window the fixed window.

I claim:

1. A window assembly comprising:

a rectangular framework having four interconnected framework members, all having in common an identical extruded first cross-section;

a sliding window having a window pane, four interconnected peripheral members respectively extending along the edges of said window pane, three of said peripheral members having in common an identical extruded second cross-section and the fourth peripheral member having said second cross-section plus an additional wall segment on the outside, and means for holding said pane against said peripheral members;

said sliding window being slidably received in said framework with a pair of opposite peripheral members of said identical second cross section slidably interfitting lengthwise with a pair of opposite framework members to guide said sliding window for slidable movement in said framework;

an additional peripheral member of the same cross-section as said fourth peripheral member extending perpendicularly between said pair of opposite framework members at a location spaced substantially from the remaining two framework members of said framework, said additional peripheral member forming part of said framework;

a fixed window pane extending between and bounded by said pair of opposite framework members, said additional peripheral member and one of said remaining two framework members, and means for holding said fixed window pane against said opposite framework members, said additional peripheral member and said one of said remaining two framework members;

said sliding window having a closed position in said framework in which its peripheral member along the opposite edge of the window pane from said fourth peripheral member extends contiguous to the other of said remaining two framework members and said fourth peripheral members extends contiguous to said additional peripheral member forming part of said framework, said sliding window being slidable along said framework from said closed position toward said one of said remaining two framework members;

and lock means for locking said sliding window in

2. A window assembly according to claim 1 and further comprising:

respective springs in said pair of opposite framework members urging said sliding window away from said closed position.

3. A window assembly according to claim 2 wherein:

each of said pair of opposite framework members has a longitudinal slot therein next to the adjacent peripheral member of the sliding window;

and said springs are tension springs in said pair of opposite framework members behind said slots;

and further comprising:

a pair of attachment members on said sliding window and respectively projecting therefrom slidably through said slots and into the adjacent framework member;

and wherein:

each of said springs is attached to one end to the corresponding attachment member and at the opposite end to the adjacent framework member.

4. A window assembly according to claim 1 wherein each of said peripheral members of said extruded second cross-section comprises:

an elongated hollow main body of rectangular cross-section and an elongated extension of rectangular cross-section joined to said main body, said main body and said extension having co-planar flat faces on one side, said extension being substantially narrower than said main body perpendicular to said co-planar faces, said main body and said extension having mutually perpendicular sides which intersect to form an inside corner on the opposite side of the peripheral member from said co-planar faces.

said mutually perpendicular sides of said main body and said extension having respective longitudinal recesses therein which intersect at said corner and respective longitudinal grooves therein located away from said corner, the remaining sides of said main body and said extension being flat.

5. A window assembly according to claim 1 wherein each of said peripheral members of said extruded second cross-section comprises:

an elongated main body of generally rectangular cross-section having a first side presenting an exposed flat face, an outer end presenting an exposed flat outer end face perpendicularly intersecting said exposed face of said first side at a first outside corner on said main body, a second side presenting an exposed flat face perpendicularly intersecting said outer end face at a second outside corner on said main body and extending from said outer end face parallel to said exposed face of said first side, and an inner end extending substantially parallel to said outer end perpendicularly between said first and second sides, said inner end forming a third outside corner with said exposed face of said second side, said inner end having a longitudinal first groove therein near said third outside corner;

and an elongated extension of generally rectangular cross-section joined to said main body at said inner end and projecting from said main body in the direction away from said outer end of the main body, said extension having a first side presenting an exposed flat face which is a coplanar continuation of said exposed face of said first side of the main body, an outer end presenting an exposed end face intersecting and extending transversely from said exposed face of said first side of the extension at a fourth outside corner spaced from said inner end of the main body, and a second side extending generally parallel to said first side of the extension from said outer end of the extension to said inner end of the main body, said second side of the extension forming a fifth outside corner with said end face of the extension and forming an inside corner with said inner end of the main body.

6. A window assembly according to claim 1 and further comprising:

means on said opposite peripheral members of said sliding window and means on said pair of opposite framework members coacting with each other to resist wind forces on said sliding window and to prevent twisting of said sliding window and said framework.

7. A window assembly according to claim 1 wherein:

each of said opposite peripheral members of said sliding window has a longitudinal recess on the side thereof away from said window pane of the sliding window;

and each of said pair of opposite framework members has a projection along its length on the side toward said sliding window which is received in said longitudinal recess in the corresponding peripheral member of the sliding window (a) to guide said sliding window for slidable movement in said framework and (b) to resist wind forces on said sliding window and prevent twisting of said sliding window and said framework.

8. A window assembly according to claim 7 wherein:

said peripheral member of said sliding window along the opposite edge of the window pane from said fourth peripheral member has a longitudinal recess on the side thereof away from said window pane of the sliding window;

and said other of said remaining two framework members has a projection along its length on the side toward said sliding window which is received in said longitudinal recess in said last-mentioned peripheral member of said sliding window when said sliding window is closed.

9. A window assembly according to claim 7 wherein each of said projections is hollow along its length, and further comprising:

respective springs in said projections urging said sliding window away from said closed position.

10. A window assembly according to claim 9 wherein:

each of said hollow projections has a longitudinal slot therein next to the adjacent peripheral member of said sliding window;

and said springs are tension springs behind said slots;

and further comprising:

a pair of attachment members on said sliding window and respectively projecting therefrom slidably through said slots and into said hollow projection of the adjacent framework member;

and wherein each of said springs is attached at one end to the corresponding attachment member and at the opposite end to the adjacent framework member.

11. A window assembly according to claim 10 wherein:

said peripheral member of said sliding window along the opposite edge of the window pane from said fourth peripheral member has a longitudinal recess on the side thereof away from said window pane of the sliding window;

and said other of said remaining two framework members has a projection along its length on the side toward said sliding window which is received in said longitudinal recess in said last-mentioned peripheral member of said sliding window when said sliding window is closed.

12. A window assembly comprising:

a rectangular framework having four interconnected framework members, all having in common an identical extruded first cross-section including a projection extending laterally inward from the respective framework member along its length;

a sliding window having a window pane, four interconnected peripheral members respectively extending along the edges of said window pane, three of said peripheral members having in common an identical extruded second cross-section and the fourth peripheral member having said second cross-section plus an additional wall segment on the outside, and means for holding said pane against said peripheral members;

said sliding window being slidably received in said framework with said projections on a pair of opposite framework members projecting into adjacent peripheral members on the sliding window of said extruded second cross-section, whereby said projections guide said adjacent peripheral members for slidable movement of said sliding window along said pair of opposite framework members;

an additional peripheral member of the same cross-section as said fourth peripheral member extending perpendicularly between said pair of opposite framework members at a location spaced substantially from the remaining two framework members of said framework, said additional peripheral member forming part of said framework;

a fixed window pane extending between and bounded by said pair of opposite framework members, said additional peripheral member and one of said remaining two framework members, and means for holding said fixed window pane against said opposite framework members, said additional peripheral member and said one of said remaining two framework members;

said sliding window having a closed position in said framework in which its peripheral member along the opposite edge of the window pane from said fourth peripheral member extends contiguous to the other of said remaining two framework members and said fourth peripheral member extends contiguous to said additional peripheral member forming part of said framework, said sliding window being slidable along said framework from said closed position toward said one of said remaining two framework members;

and lock means for locking said sliding window in said closed position.

13. A window assembly according to claim 12 wherein each of said peripheral members of said extruded second cross-section comprises:

an elongated hollow main body of rectangular cross-section and an elongated extension of rectangular cross-section joined to said main body, said main body and said extension having co-planar flat faces on one side, said extension being substantially narrower than said main body perpendicular to said co-planar faces, said main body and said extension having mutually perpendicular sides which intersect to form an inside corner on the opposite side of the peripheral member from said co-planar faces, said mutually perpendicular sides of said main body and said extension having respective longitudinal recesses therein which intersect at said corner and respective longitudinal grooves therein located away from said corner, the remaining sides of said main body and said extension being flat.

14. A window assembly according to claim 12 wherein each of said peripheral members of said extruded second cross-section comprises:

an elongated main body of generally rectangular cross-section having a first side presenting an exposed flat face, an outer end presenting an exposed flat outer end face perpendicularly intersecting said exposed face of said first side at a first outside corner on said main body;

a second side presenting an exposed flat face perpendicularly intersecting said outer end face at a second outside corner on said main body and extending from said outer end face parallel to said exposed face of said first side, and an inner end extending substantially parallel to said outer end perpendicularly between said first and second sides, said inner end forming a third outside corner with said exposed face of said second side, said inner end having a longitudinal first groove therein near said third outside corner;

and an elongated extension of generally rectangular cross-section joined to said main body at said inner end and projecting from said main body in the direction away from said outer end of the main body, said extension having a first side presenting an exposed flat face which is a coplanar continuation of said exposed face of said first side of the main body, an outer end presenting an exposed end face intersecting and extending transversely from said exposed face of said first side of the extension at a fourth outside corner spaced from said inner end of the main body.

and a second side extending generally parallel to said first side of the extension from said outer end of the extension to said inner end of the main body, said second side of the extension forming a fifth outside corner with said end face of the extension and forming an inside corner with said inner end of the main body.

15. A window assembly according to claim 12 wherein said lock means acts between said fourth peripheral member of the sliding window and said additional peripheral member.

16. A window assembly according to claim 12 wherein said pair of opposite framework members extend up along the opposite sides of said framework.

17. A window assembly according to claim 16 wherein said sliding window is the lower window in said framework.

18. A window assembly according to claim 17 wherein said lock means acts between the peripheral member at the top of said sliding window and said additional peripheral member.

19. A window assembly according to claim 12 wherein said pair of opposite framework members extend substantially horizontally along the top and bottom of said framework.

20. A window assembly according to claim 19 wherein said lock means acts between said fourth peripheral member of the sliding window and said additional peripheral member.

21. A window assembly according to claim 12 wherein:

said projections on said pair of opposite framework members are hollow and have respective longitudinal slots therein next to said adjacent peripheral members of the sliding window which open into the hollow interior of the respective projections, each of said slots extending along the corresponding projection to said other of said remaining two framework members;

and further comprising:

a pair of attachment members mounted on said opposite peripheral member and respectively extending from its opposite ends slidably through said slots and slidably received in the hollow interiors of said projections on said pair of opposite framework members;

and a pair of springs received in the hollow interiors of said projections on said pair of opposite framework members, said springs acting between said pair of opposite framework members and said attachment members to pull said window away from said closed position.

22. A window assembly according to claim 21 wherein:

said pair of opposite framework members extend up along opposite sides of the framework;

and said sliding window is the lower window in said framework.

23. A window assembly according to claim 21 wherein:

said pair of opposite framework members extend substantially horizontally along the top and bottom of said framework.

24. A window assembly according to claim 21 wherein each of said framework members is an elongated extruded body having in cross-section:

a hollow main body of generally rectangular cross-section having a flat outer first side adapted to extend next to an edge of a window opening in a building wall, a first end extending transversely from said outer first side to face the inside of the building, a second and extending transversely from said outer first side and spaced from said first end to face the outside of the building, an inner second side joined to said second end and extending therefrom toward said first end in spaced, substantially parallel relationship to said outer first side, and said projection extending laterally inward from said inner second side, and means defining a slot of substantially T-shaped cross-section located laterally inward from said inner second side between said second end and said projection and open on the laterally inward side of said framework member;

a first extension having an outer side which is a continuation of said outer first side of said main body beyond said second end toward the outside of the building, said first extension being joined to said second end of said main body at an inside corner of said framework member, said first extension having a laterally inwardly protruding projection thereon spaced from and facing toward said inside corner;

and a second extension joined to said main body diagonally opposite said first extension and extending from said outer first side laterally inward farther than said projection on said inner second side of said main body, said second extension having a generally T-shaped slot therein located laterally inward beyond said projection on said inner second side of said main body and open toward the outside of the building.

25. An elongated extruded framework member for attachment along an edge of a window opening in a building wall, said framework member comprising in cross-section:

a hollow main body of generally rectangular cross-section having a flat outer first side adapted to extend next to the edge of the window opening in the building wall, a first end extending transversely from said outer first side to face the inside of the building, a second end extending transversely from said outer first side and spaced from said first end to face the outside of the building, an inner second side joined to said second end and extending therefrom toward said first end in spaced substantially parallel relationship to said outer first side, a projection extending laterally inward from said inner second side, and means defining a slot of substantially T-shaped cross-section located laterally inward from said inner second side between said second end and said projection and open on the laterally inward side of said framework member;

a first extension having an outer side which is a continuation of said outer first side of said main body beyond said second end toward the outside of the building, said first extension being joined to said second end of said main body at an inside corner of said framework member, said first extension having a laterally inwardly protruding projecion thereon spaced from and facing toward said inside corner;

and a second extension joined to said main body diagonally opposite said first extension and extending from said outer first side laterally inward farther than said projection on said inner second side of said main body, said second extension having a generally T-shaped slot therein located laterally inward beyond said projection on said inner second side of said main body and open toward the outside of the building.

26. A framework member according to claim 25 wherein said projection on said inner second side of said main body has a hollow interior along its length.

27. A framework member according to claim 26 wherein said slot in said second extension is offset from said first end of said main body in the direction away from said projection.

28. A framework member according to claim 25 wherein said slot in said second extension is offset from said first end of said main body in the direction away from said projection.

29. An elongated extruded framework member for attachment along an edge of a window opening in a building wall, said framework member comprising in cross-section:

a hollow main body of generally rectangular cross-section having a flat outer first side adapted to extend next to the edge of the window opening in the building wall, a first end extending transversely from said outer first side to face the inside of the building, a second end extending transversely from said outer first side and spaced from said first end to face the outside of the building, an inner second side joined to said second end and extending therefrom toward said first end in spaced substantially parallel relationship to said outer first side, a projection extending laterally inward from said inner second side, and means located laterally inward from said inner second side between said second end and said projection for holding a weatherstrip member;

a first extension having an outer side which is a continuation of said outer first side of said main body beyond said second end toward the outside of the building, said first extension being joined to said second end of said main body at an inside corner of said framework member, said first extension having a laterally inwardly protruding projection thereon spaced from and facing toward said inside corner;

and a second extension joined to said main body diagonally opposite said first extension and extending from said outer first side laterally inward farther than said projection on said inner second side of said main body, said second extension having means thereon for holding a weatherstrip member.

* * * * *